US011191331B2

(12) United States Patent
Zemel et al.

(10) Patent No.: US 11,191,331 B2
(45) Date of Patent: Dec. 7, 2021

(54) COLLAPSIBLE CADDY

(71) Applicant: Mr. Bar-B-Q Products LLC, Melville, NY (US)

(72) Inventors: Marc Zemel, Melville, NY (US); Joanne Rudis, Melville, NY (US)

(73) Assignee: MR. BAR-B-Q PRODUCTS LLC, Hauppauge, NY (US)

( * ) Notice: Subject to any disclaimer, the term of this patent is extended or adjusted under 35 U.S.C. 154(b) by 239 days.

(21) Appl. No.: 16/429,543

(22) Filed: Jun. 3, 2019

(65) Prior Publication Data

US 2019/0373994 A1 Dec. 12, 2019

Related U.S. Application Data

(60) Provisional application No. 62/681,270, filed on Jun. 6, 2018.

(51) Int. Cl.

| | |
|---|---|
| ***A45C 5/04*** | (2006.01) |
| ***B65D 25/08*** | (2006.01) |
| ***B65D 25/04*** | (2006.01) |
| ***A45C 7/00*** | (2006.01) |
| ***B65D 21/08*** | (2006.01) |

(52) U.S. Cl.

CPC ..... *A45C 5/045* (2013.01); *B65D 25/04* (2013.01); *B65D 25/08* (2013.01); *A45C 7/0036* (2013.01); *B65D 21/08* (2013.01); *B65D 21/086* (2013.01)

(58) Field of Classification Search

CPC ..... A45C 5/045; A45C 7/036; B65D 25/04; B65D 25/08; B65D 25/086

USPC ... 220/6, 666, 729, 521, 523, 740, 504, 554, 220/555, 503; 206/541, 532

See application file for complete search history.

(56) References Cited

U.S. PATENT DOCUMENTS

| | | | | |
|---|---|---|---|---|
| D168,277 | S | 11/1952 | Roberts | |
| 3,032,230 | A | 5/1962 | Gerber | |
| D283,457 | S | 4/1986 | Smith | |
| 4,819,795 | A * | 4/1989 | Swaney | B65D 21/0222 206/278 |
| D330,219 | S | 10/1992 | Carlson et al. | |
| 5,242,223 | A * | 9/1993 | Koves | A47B 88/994 312/348.3 |
| D358,484 | S | 5/1995 | Cautereels et al. | |
| D361,664 | S | 8/1995 | Brown | |

(Continued)

*Primary Examiner* — Chun Hoi Cheung

(74) *Attorney, Agent, or Firm* — Carter, DeLuca & Farrell LLP

(57) ABSTRACT

A collapsible caddy for organizing, storing, and carrying food, condiments, paper goods, or utensils is provided having a lip including a body, the body having a substantially rectangular-shaped profile defining an opening there along, an interior surface, and an exterior surface, where the opening of the lip defines a lip axis and the interior surface includes one female connector, one handle extends away from the exterior surface and connects to a movable handle or handlebar; a membrane including a resilient and tubular body defining a top portion connected to the lip and a lower portion, the body having a substantially trapezoidal-shaped transverse cross-sectional profile defining an opening therealong, wherein the opening extends from the top portion to the lower portion, and a base including a substantially rectangular and flat body defining a surface base, the base connected to the lower portion of the membrane.

9 Claims, 8 Drawing Sheets

(56) References Cited

U.S. PATENT DOCUMENTS

D364,961 S 12/1995 Rehrig
5,499,473 A * 3/1996 Ramberg ..... A01K 97/05 43/55
D369,242 S 4/1996 Tiramani
D451,281 S 12/2001 Wodkowski et al.
6,336,584 B1 1/2002 Roch et al.
D492,113 S 6/2004 Bayer et al.
7,654,402 B2 * 2/2010 Kusuma ..... B65D 21/086 220/8
7,678,271 B2 * 3/2010 Curtin ..... A47J 43/24 210/232
D630,478 S 1/2011 Bell
D642,870 S 8/2011 Whitlock et al.
8,313,000 B1 * 11/2012 Tuan ..... B65D 25/282 220/6
8,430,265 B2 * 4/2013 Vanderberg ..... B65D 21/086 220/666
8,448,813 B2 5/2013 Vanderberg et al.
8,887,942 B2 * 11/2014 Miksovsky ..... B65D 1/40 220/521
9,079,685 B2 * 7/2015 Sudakoff ..... B65D 43/0218
9,386,886 B2 * 7/2016 Lee ..... A47J 47/20
9,687,064 B2 6/2017 Mellick et al.
D795,584 S 8/2017 Walker, Jr. et al.
D826,509 S 8/2018 Foley et al.
10,196,169 B2 * 2/2019 Tsui ..... A47L 17/02
D843,113 S 3/2019 Carter et al.
D894,696 S * 9/2020 Tsui ..... D7/667
2002/0096525 A1 * 7/2002 Bertoldo ..... B44D 3/122 220/544
2006/0096929 A1 * 5/2006 Repp ..... A47J 19/00 210/740
2007/0023439 A1 * 2/2007 Vaughn ..... F25D 3/08 220/592.03
2007/0241154 A1 * 10/2007 Potts ..... B60R 7/02 224/539
2012/0000912 A1 * 1/2012 Potts ..... B65D 21/086 220/553
2014/0238995 A1 * 8/2014 Vargas ..... B65D 25/06 220/523
2014/0246445 A1 * 9/2014 Lee ..... A47L 19/04 220/666
2015/0253055 A1 * 9/2015 Tsui ..... B62B 5/066 62/62
2016/0059990 A1 * 3/2016 Patikas-Bryant .... B65D 43/164 220/523
2017/0231435 A1 * 8/2017 Lee ..... B65D 43/02 220/6
2018/0148221 A1 * 5/2018 Hill ..... B65D 25/08

* cited by examiner

COLLAPSIBLE CADDY

BACKGROUND

Technical Field

The present disclosure relates to foldable containers which are used for storing, carrying and organizing items, condiments, paper goods, utensils, and others. More specifically, the present disclosure relates to a collapsible caddy which can be configured to store, carry, and organize food items, paper goods, and utensils, and methods of using the same.

Description of Related Art

Storage containers for storing food items are well known. Picnic or barbecue baskets are also well known for storing, carrying or organizing barbecue or picnic utensils, paper goods and food.

Thus far, plastic, metal or glass containers that are used for storing, carrying or organizing multiple utensils, paper goods and food items are bulky or single use. In addition, these types of containers usually have a single storage compartment of a single size. One main disadvantage of these types of containers is its size, requiring a large amount of storage space when not used. Another disadvantage of the containers in the art are having to purchase many of them of differing sizes to accommodate different sized items thereby taking up more storage space in the home.

Accordingly, a need exists for a simple, compact and efficient storage and organization system including customizable space to organize, carry and store utensils, paper goods and food items, i.e., such as, but not limited to, those items required for a barbecue or picnic.

SUMMARY

A simple, compact and efficient storage and organization system including customizable space to organize, carry and store utensils, paper goods and food items, i.e., such as, but not limited to, those items required for a barbecue or picnic is provided.

According to an aspect of the present disclosure, the storage and organizations system includes a collapsible caddy for easy storage.

In another aspect of the present disclosure, the collapsible caddy is provided having a lip including an elongated body, the elongated body of the lip having a substantially rectangular-shaped transverse cross-sectional profile defining an opening there along, an interior surface, and an exterior surface, wherein the opening of the lip defines a lip entry axis and the interior surface includes at least one female connector, where at least one handle extends away from the exterior surface and connects to a handlebar which connects to the lip.

The collapsible caddy includes a membrane including a resilient and tubular body defining a top portion connected to the lip and a lower portion, the tubular body having a substantially trapezoidal-shaped transverse cross-sectional profile defining an opening therealong, wherein the opening extends from the top portion to the lower portion, and wherein the opening of the membrane defines a membrane entry axis aligned with the lip entry access from the lip.

The base of the collapsible caddy includes a substantially rectangular and flat body defining a surface base, the base being connected to the lower portion of the membrane and the surface base including a lip and at least one female connector, wherein the at least one female connector of the surface base aligns with the at least one female connector of the lip.

In another aspect of the present disclosure, the collapsible caddy may be configured to transition from a collapsed configuration to an extended or open configuration.

In another aspect of the present disclosure, the base may be receivable through the opening of the lip when the collapsible caddy is folded.

BRIEF DESCRIPTION OF THE DRAWINGS

The accompanying drawings, which are incorporated in and constitute a part of this specification, illustrate embodiments of the present disclosure and, together with a general description of the present disclosure given above, and the detailed description of the embodiments given below, serve to explain the principles of the present disclosure.

DETAILED DESCRIPTION

Detailed embodiments of the present device are disclosed herein. It is to be understood, however, that the disclosed embodiments are merely exemplary of the device as a whole, which may be embodied in various and alternative forms. The figures are not necessarily to scale, and some figures may be configured to show the details of a particular component. Therefore, specific structural and functional details disclosed herein are not to be interpreted as limiting, but merely as a representative basis for the claims and for teaching one skilled in the art to practice the present invention.

Figure 1:
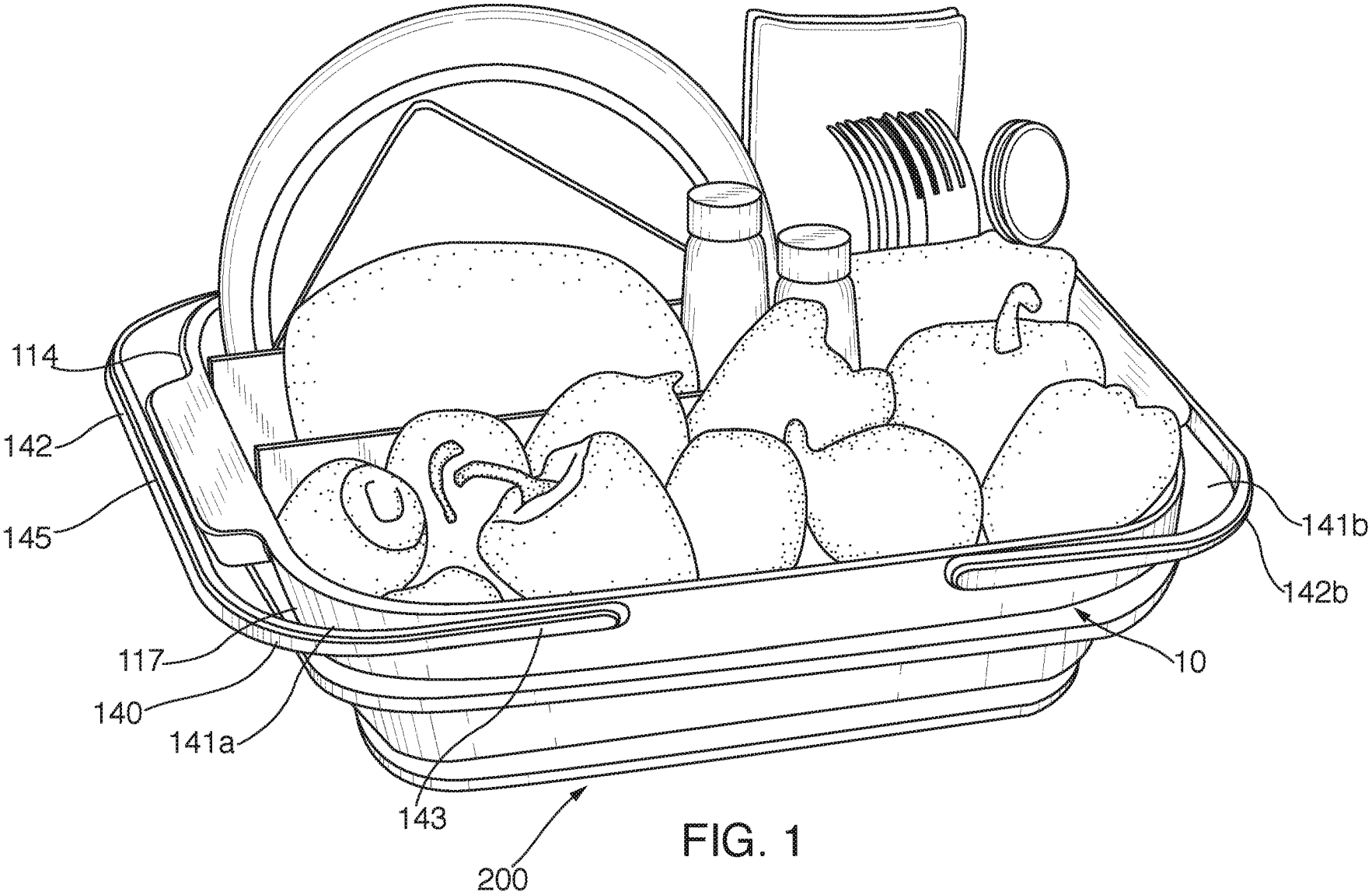
FIG. 1 is a perspective side view of a collapsible caddy and collapsible caddy system in an extended configuration according to an embodiment of the present disclosure.
Figure 2:
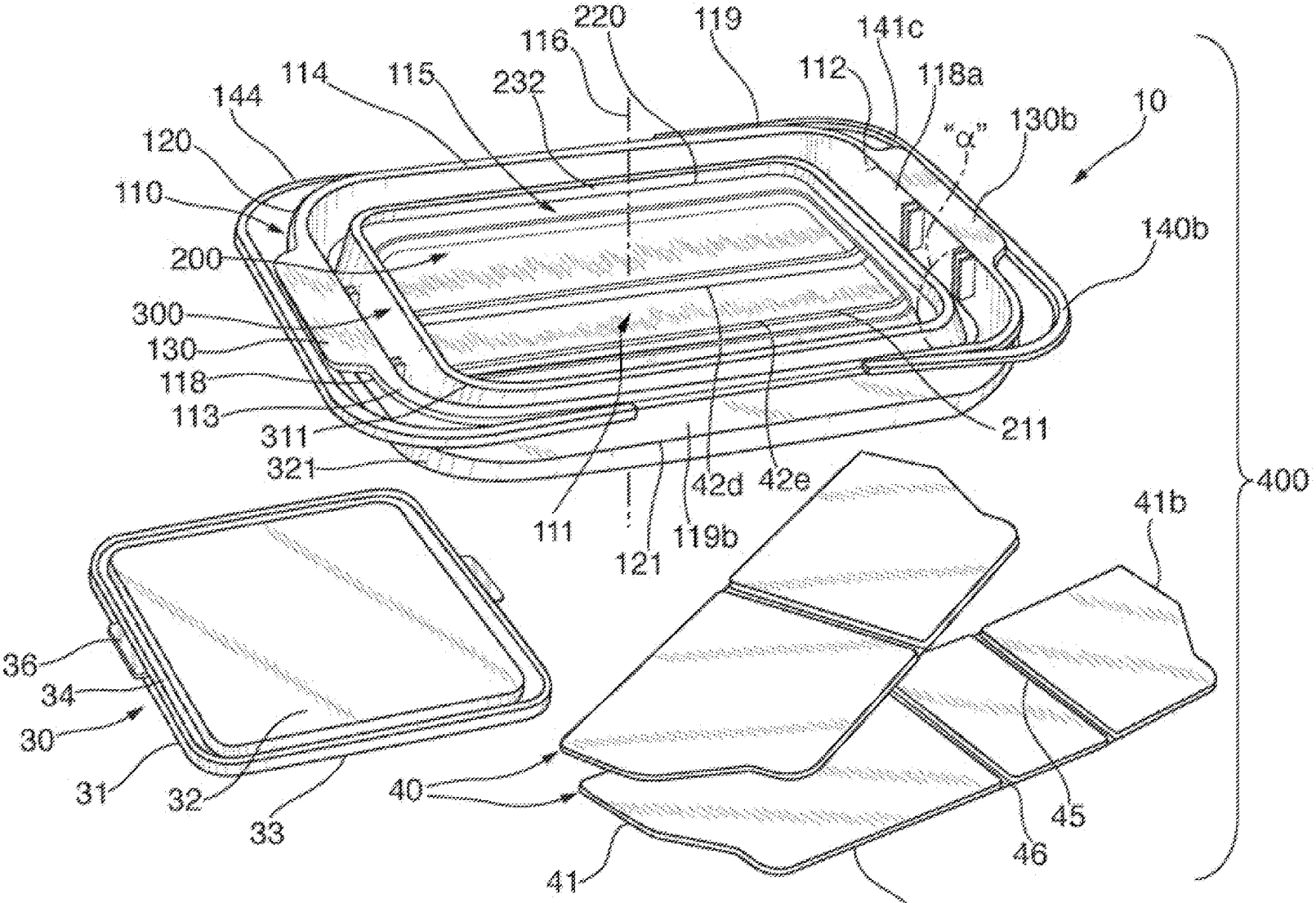
FIG. 2 is a perspective side view of a collapsible caddy in a collapsed configuration disposed adjacent to two tabs and a cover of the collapsible caddy system of FIG. 1
Figure 3:
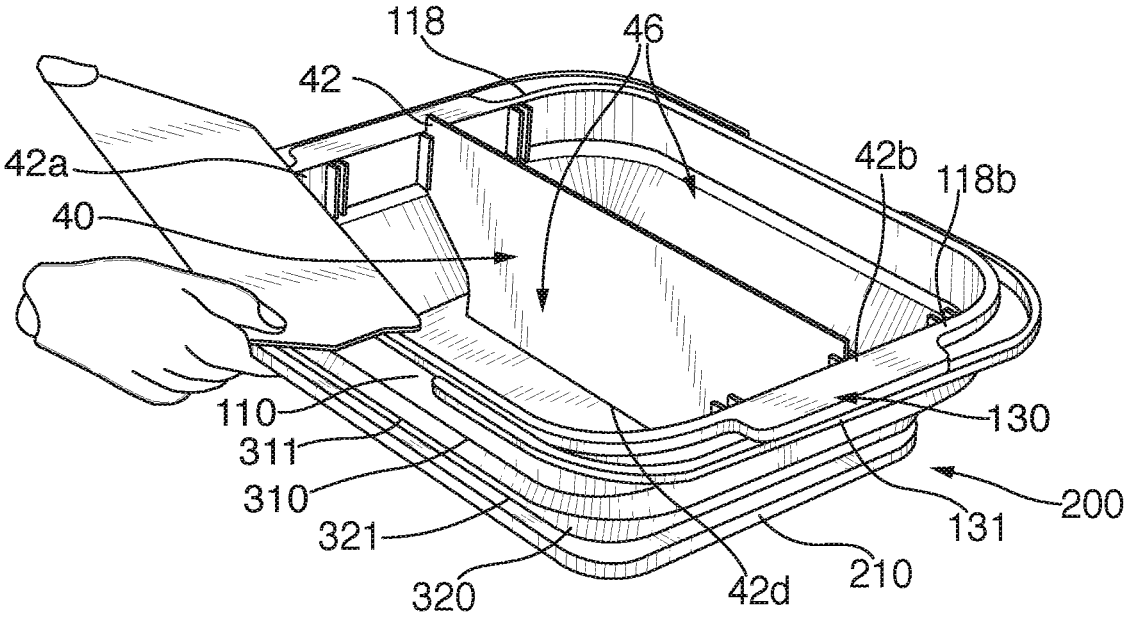
FIG. 3 is a perspective side view of the collapsible caddy system of FIG. 1 in an extended configuration where the caddy is receiving two tabs.

Referring generally to FIGS. 1-3, a collapsible caddy 10 for food, paper goods, utensils, or any items requiring organization and/or storage is provided. The collapsible caddy 10 includes a lip 110 and a base 200 which may be connected via a collapsible wall or membrane 300. The lip 110 includes a body 111, inner surface 112, outer surface 113, and lip opening 114 defining a channel or central opening 115. The central opening 115 is disposed through the body 111 and at the center thereof defining a first longitudinal axis 116.

Body 111 may be configured to include an approximately rectangular transverse cross-sectional profile and multiple sides similar to a parallelogram. The sides of body 111 may define angles "α", which in embodiments may be right angles, and curved corners 117, where the sides of the body are joined. For example, the body 111 may include four parallelogram sides 118, 118*a*, 119, and 119*b*. More specifically, side 118 is similar to side 118*b*, and side 119 is similar to side 119*b*. Body 111 defines a top surface 120 and a bottom surface 121. The central opening 115 extends through body 111 connecting top surface 120 to bottom surface 121.

In embodiments, the collapsible caddy 10 may include first and second handles 130 and 130*b* each connecting to a respective side 118, and 118*b*. Alternately, the first and second handles 130, 130*b* may protrude from body 111, more specifically, may protrude orthogonally to the longitudinal axis 116 and away from sides 118, and 118*b*. Further, it may be desired to operably connect a pair or movable handles or handlebars 140, and 140*a* to the body 111 and further configure the handlebars to connect to handles 130, and 130*b* respectably. While in use, the handlebars 140 and 140*a* may define a plurality of openings 141, 141*a*, 141*b*, and 141*c* which can be used to receive a selected element such as a spoon, cutlery, or the like. It is understood that handlebar 140 and handlebar 140*b* are substantially similar to one another. Thus, the description of one handlebar incorporates the other handlebar. More in detail, handlebar 140 may have a substantially elongated body 142 (which in embodiments may be curved) defining a first end 143 configured to connect to side 118, a second end 144 configured to connect to side 118*b*, and a middle portion 145 configured to connect to handle 130. Openings 141, and 141*a* are disposed between the outer surface 113 and the handlebar 140. In other words, openings 141 and 141*a* are respectively defined by handlebar 140, handle 130, and outer surface 113. It is understood that handlebar 140*b* may connect to the second handle 130*b* and body 111 defining openings 141*c*, and 141*d*. As mentioned above, handlebars 140 and 140*b* may be configured as movable handlebars and in selected embodiments it may be desired to have handles 130, and 130*b* to further include each a flap 131. Each flap 131 may be configured to connect to a respective handlebar 140, 140*b*. For example, handlebars 140 and 140*b* may be connected to the lip 110, via a connector 11, in such a way that pivots from a first configuration (FIG. 3) to a second configuration (FIG. 7), and ultimately rest on respective flaps 131.

Still with reference to FIGS. 1-3, and as mentioned above, lip 110 is connected to the base 200 via a collapsible wall or membrane 300. Membrane 300 may be formed of any resilient or pliable material such as but not limited to polymers (e.g. silicone, rubber, plastic, resin, or the like) or malleable metals (e.g. aluminum, cooper, or the like) and may include a top portion 310 dimensioned to connect to the lip 110 near the bottom surface 121, and a lower portion 320 dimensioned to connect to the base 200. The membrane 300 may include respective hinge portions 311, and 321 near the top portion 310 and the lower portion 320. The membrane 300 can be configured to bend at each hinge portion, the hinge portions 311 and 321 may be dimensioned thinner than the rest of the membrane 300.

Further, collapsible caddy 10 may be configured to transition from a collapsed configuration (FIG. 2) to an expanded or open configuration (FIGS. 2 and 3), and further can be included in system 400. System 400 may include collapsing device 10, at least one divider tab 40 configured to connect to the lip 110 and/or the base 200, and a cover 30. In general, the lip 110 and the base 200 may include female connectors configured to connect to a respective male connector which may be included in divider 40. It is understood, that the male connectors and the female connectors can be of any shape as long as the two portions are dimensioned and configured to form a secure connection when ultimately mated one another. In exemplary embodiments, in general, the female connectors are configured as openings or receiving channels disposed onto lip 110 or base 200. In embodiments, selected female connectors can be configured in parallel one to another along lip 110, and further configured in parallel with longitudinal axis 116. The male connectors may be configured as tabs included in divider 40 which are reciprocally dimensioned to connect to the female connectors. For example, as seen in FIGS. 2 and 3, side 118 may include female connectors 42, 42*a*, and opposing side 118*a* includes female connectors 42*b*, and 42*c*. Female connector 42 is parallel to the female connector 42*b*, and female connector 42*a* is parallel to female connector 42*c*, each parallel pair of female connectors can be configured to receive a divider 40. Examples of system 400 and divider 40 will be described in more detail herein below.

In general, base 200 may be a parallelogram with round corners. It is understood, that in embodiments the base 200 may have different shape configurations (e.g. rectangular, circular, etc). In exemplary embodiments such as illustrated in FIGS. 2-3, base 200 defines a substantially rectangular body or base body 210. The base body 200 defines a top surface or base surface 211, a lower surface or base surface 212, a base lip 220, and at least one female connector 42*d* (which can be disposed near the base surface 211 or near the base surface 212). The female connector 42*d* is substantially similar to connectors 42-42*c*. Female connector 42*d* is substantially elongated and is disposed on the base surface 211, in embodiments, it may be desired to have connector 42*d* align with a selected pair of the female connectors of the lip 110. In embodiments, the base 200 may include more than one female connector, and further have the female connectors configured to align with a pair of female connectors from lip 110. For example in FIGS. 2 and 3, base 200 includes female connectors 42*d* and 42*e*, the two female connectors protruding away from surface 211 and including a substantially U-shape transverse cross-sectional profile.

Figure 8:
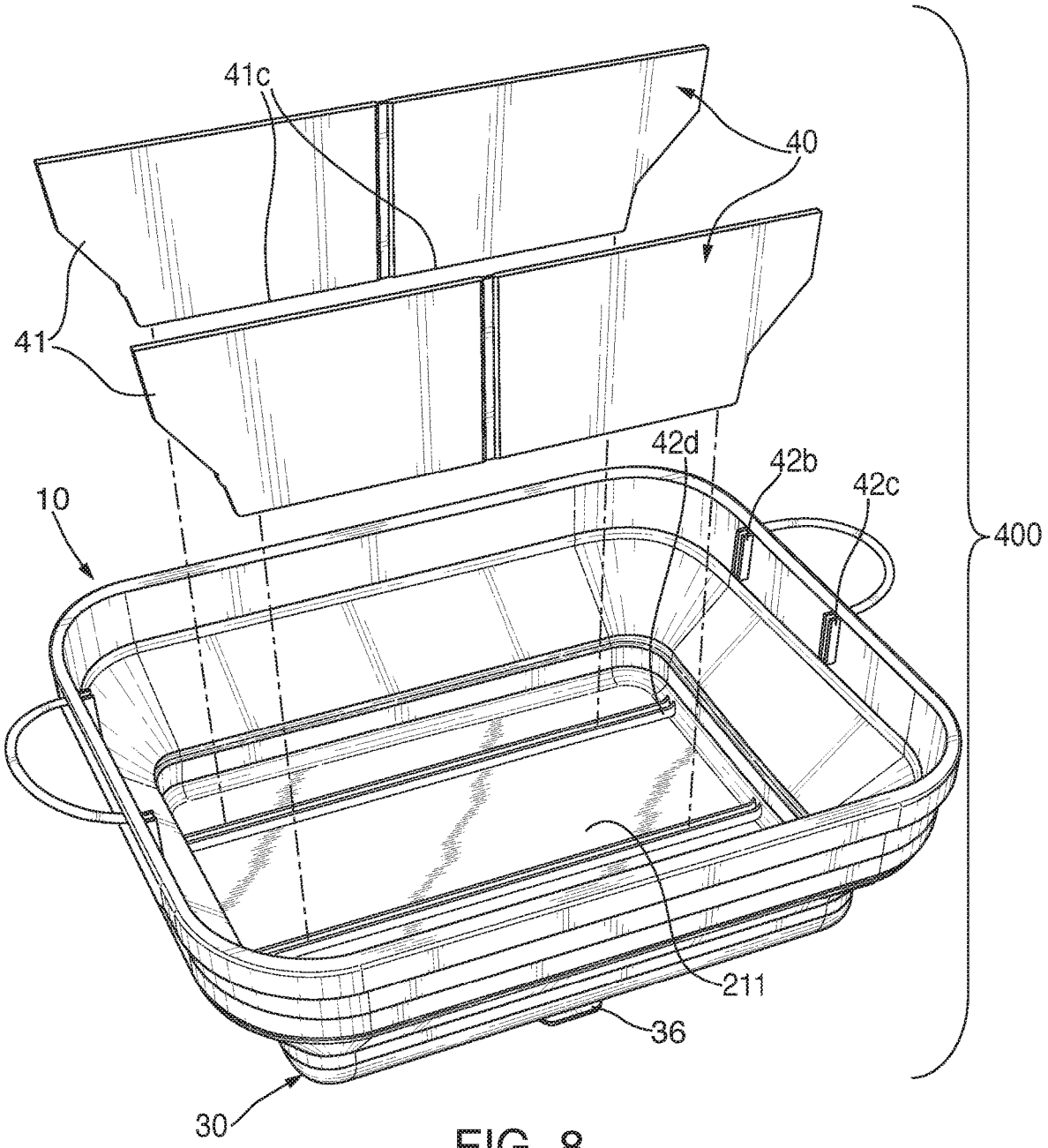
FIG. 8 is a perspective top view of the collapsible caddy of FIG. 1 receiving two tabs.

As mentioned above, system 400 may further include at least one divider 40 configured to connect to the collapsible caddy 10. More specifically, divider 40 may include at least one male connector 41 connected to a divider body 45, and a divider hinge 46 which may enable folding of the divider 40 in half. In embodiments, divider 40 may include more than one male connector 41. For example, as seen in FIGS. 1 2, and 8 divider 40 includes male connectors 41, and 41*a* configured to connect with female connectors 42 and 42*b*, respectively, and male connector 41*c* is configured to connect with female connector 42*d*. While in use, a user can fold collapsible caddy 10 from a first configuration (FIG. 1), i.e., an open or extended configuration, to a second configuration (FIG. 2), i.e., a closed or collapsed configuration. Further, the user can connect male connectors 41, 41*b*, and 41*c* to female connectors 42, 42*b*, and 42*d*, respectively, by sliding the divider 40 through the central opening 115 following the direction of the longitudinal axis 116. In embodiments, the collapsible caddy 10 may be configured in such a way that the divider 40 may assist membrane 300 to maintain an extended configuration. It is understood, that the divider body 45 and the female connectors may be configured to couple to membrane 300 (when open or extended). Still while in use, the divider 40, when connected to the collapsible caddy 10 (when open or extended), further defines pockets 46 which are configured to receive food, paper goods, utensils or the like such as an exemplary embodiment depicted in FIG. 3.

Figure 4:
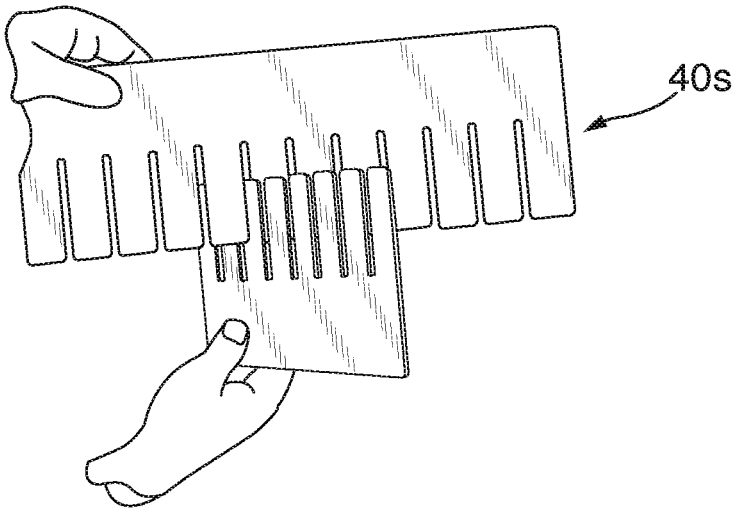
FIG. 4 is a perspective front view of an alternate embodiment of tabs according to embodiments of the present disclosure.
Figure 5:
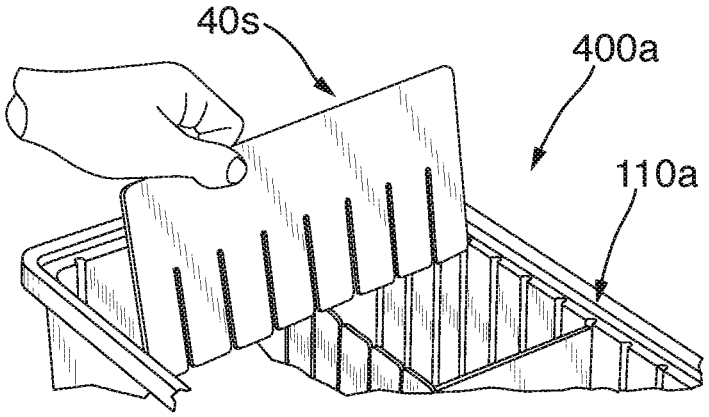
FIG. 5 is a perspective side view of an alternate embodiment of the collapsible caddy system of FIG. 1.

Turning now to FIGS. 4-5, an alternate embodiment of system 400, labeled system 400*a* is presented. System 400*a* includes a divider 40*s* including a plurality of female connectors 41*s* which are configured to connect to one or more dividers 40*s* and a collapsible caddy 110*a*.

Figure 6:
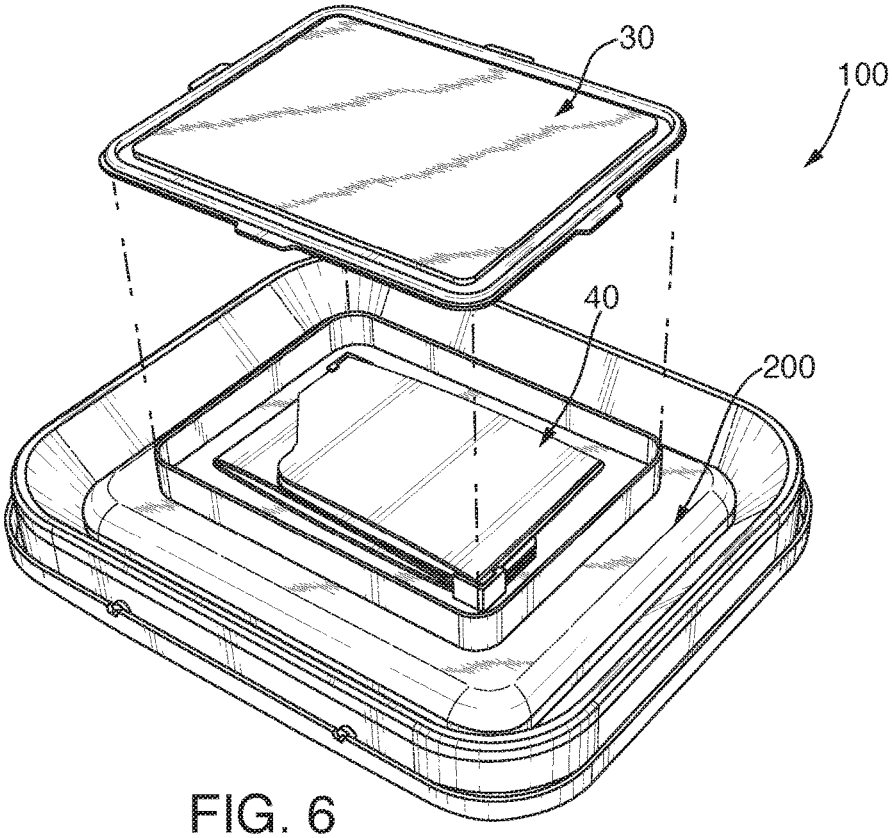
FIG. 6 is a perspective bottom view of the collapsible caddy of FIG. 1 receiving the cover.
Figure 7:
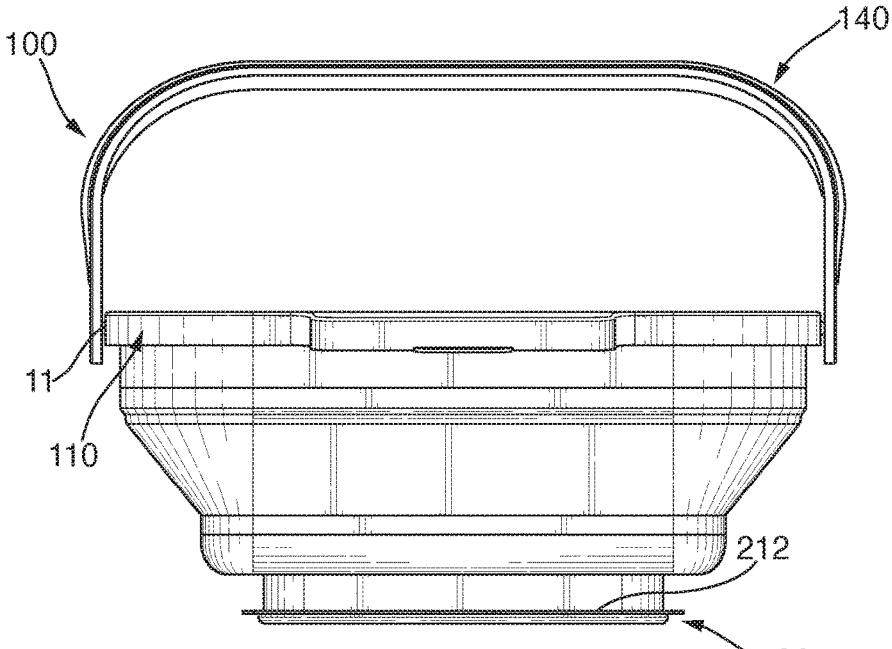
FIG. 7 is a side view of the caddy system of FIG. 1.

With reference to FIGS. 2, 6 and 7, cover 30 may include a substantially rectangular flat body or cover body 31 which defines a cover surface 32. The cover body 31 includes a channel 34 and defines a perimeter 33. The channel 34 may extend along the perimeter 33. Cover 30 may be configured to connect to base 200 or lip 110, and in embodiments, it may further include connecting features to secure cover 30 thereof. For example, as seen in FIG. 2, cover 30 is dimensioned to connect to base 200 and includes a cover tab 36 which extends away from cover body 32. Further, base 200 may be configured to include a connector 232 disposed at a top surface 200*a* of the base 200 (FIG. 2), or alternatively, the connector 232 may be disposed near a bottom surface 200*b* (bottom surface 200*b* is opposed to the top surface 200*a*), which can be configured to connect to the cover tab 36. While in use, a user can connect cover tab 36 to the connector 232 and form a secure connection from that place. In further embodiments, divider 40 may be stored between base 200 and cover 30, as seen in the exemplary embodiment in FIG. 6 or as seen in FIG. 7. More specifically, in embodiments at least one divider 40 can be disposed between the cover 30 and the base surface 111 or between the cover 30 and the base surface 112.

Figure 9:
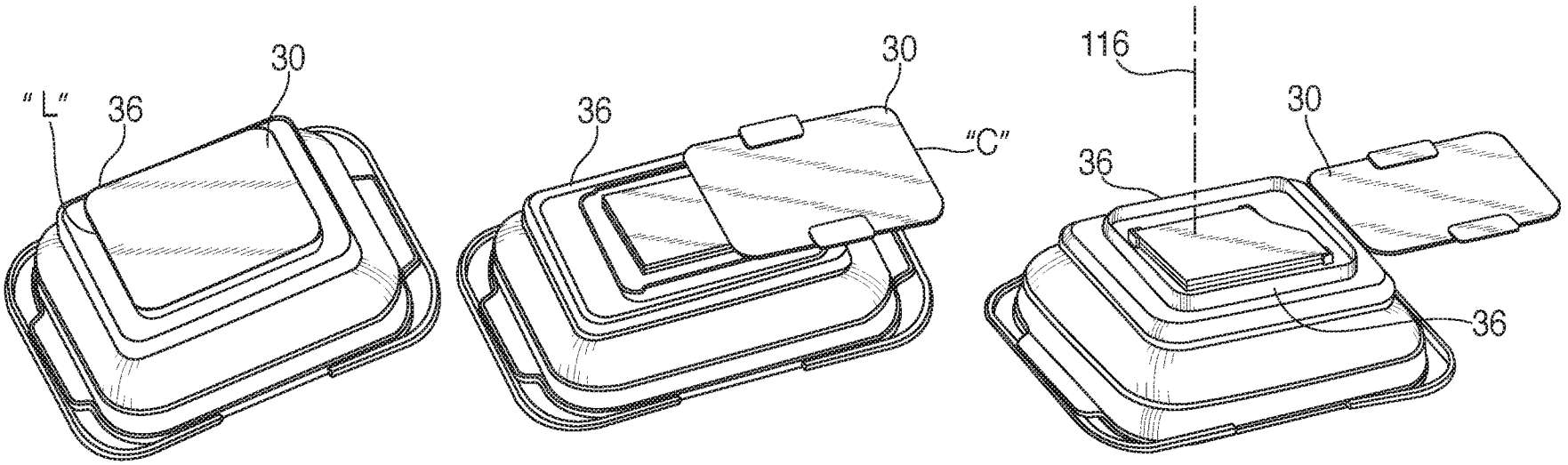
FIG. 9 is a schematic representation and bottom view which depicts the cover of the collapsible caddy system of FIG. 1 being stored in the collapsible caddy of FIG. 1.
Figure 10:
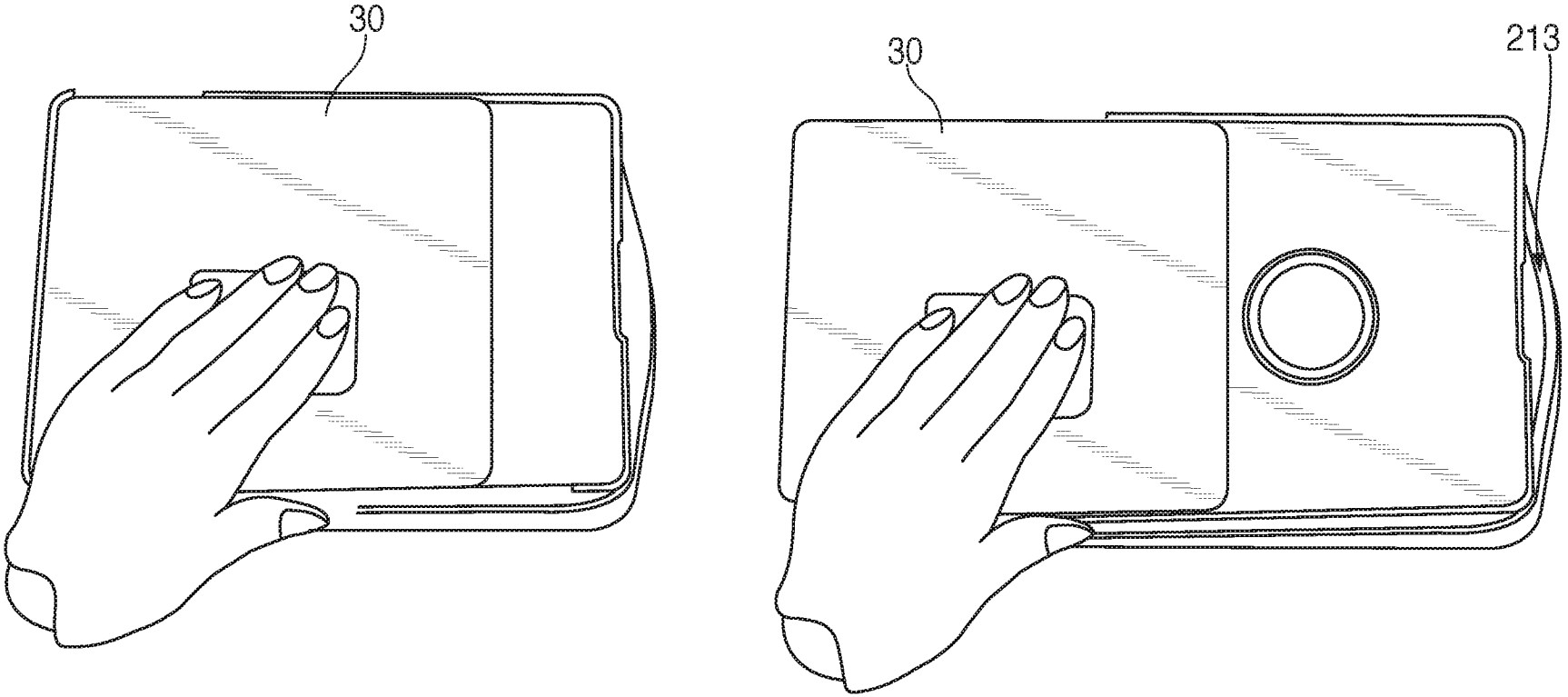
FIG. 10 is a schematic representation and bottom view which depicts a cover being store in an alternative embodiment of a collapsible caddy according to embodiments of the present disclosure.

Now turning to FIGS. 9 and 10, and still with respect to the lid or cover 30. In selected embodiments, the system 400 may further include a channel 213 near the base 200 configured to receive the cover 30. Generally, channel 213 defines an opening (not shown) having a substantially C or U shape which is perpendicular to the base 200. In embodiments, the length "L" of the opening may be substantially similar to a length "C" which is the length of the tab 36. Alternatively, the tab 36 extends along a boundary "B" of the cover 30 (FIG. 10). It is understood that in embodiments, the system 400 may include a plurality of tabs 36, for example, as seen in FIG. 10. While in use, a user can slide the cover 30 through the channel 213 in a position substantially parallel to the base 200 and perpendicular to the axis 116 as seen in FIGS. 9 and 10.

It will be understood that various modifications may be made to the embodiments described by the present disclosure. Therefore, the above description should not be construed as limiting, but merely as exemplifications of embodiments. Those skilled in the art will envision other modifications within the scope and spirit of the present disclosure.

What is claimed is:

1. A collapsible caddy comprising:

a lip including a body, the body of the lip including a rectangular-shaped transverse cross-sectional profile defining an opening there along, the body defining an interior surface, and an exterior surface, wherein the opening of the lip defines a lip entry axis and the interior surface includes at least one female connector, wherein at least one handle extends away from the exterior surface and connects to a handlebar connected to the lip;

a membrane including a resilient tubular body defining a top portion connected to the lip and a lower portion, the body of the membrane including a trapezoidal-shaped transverse cross-sectional profile defining an opening there along, wherein the opening of the membrane extends from the top portion to the lower portion, wherein the opening of the membrane defines a membrane entry axis aligned with the lip entry access from the lip;

a base including a rectangular and flat body defining a top surface and a bottom surface opposite the top surface, the base connected to the lower portion of the membrane and the top surface including a lip and at least one female connector, wherein the at least one female connector is aligned with the at least one female connector included in the lip; and a cover including a flat body defining a cover body, wherein the cover is configured to connect to the bottom surface of the base, wherein the collapsible caddy is configured to transition from a collapsed configuration to an extended configuration; and wherein the base is receivable through the opening of the lip when the collapsible caddy is folded.

2. The collapsible caddy according to claim 1, further comprising:

at least one divider including at least one first male connector configured to connect to the female connector of the lip, and at least one second female connector configured to connect to the at least one female connector of the base.

3. An organization and storage system, the system comprising:

a tab configured for insertion into an opening, the tab having a plurality of male connectors disposed therein;

a membrane capable of receiving the tab when the membrane is at an extended configuration, the membrane being configured to collapse from an extended configuration to a folded configuration;

a base configured to connect to the membrane, the base having at least one female connector configured to connect to at least one of the plurality of male connectors of the tab and defining a top surface and a bottom surface opposite the top surface;

a lip configured to connect to the membrane and the tab; and a cover configured to connect to the bottom surface of the base, wherein the tab can be stored between the bottom surface of the cover and the base.

4. The organization and storage system of claim 3, further comprising at least one handle connected to the lip and at least one movable handle operably connected to the lip.

5. The organization and storage system of claim 4, where in the at least one movable handle is configured to pivot relative to the lip and configured to rest onto the handle.

6. The organization and storage system of claim 3, wherein the lip further includes a female connector configured to be received at least one of the plurality of male connectors of the tab.

7. The collapsible caddy according to claim 2, wherein the at least one divider is stored in a space between the cover and the base.

8. The organization and storage system according to claim 3, further comprising:

at least one divider including at least one first male connector configured to connect to a female connector of the lip, and at least one second female connector configured to connect to at least one female connector of the base.

9. The organization and storage system of claim 8, wherein the at least one divider is stored in a space between the cover and the base.

* * * * *